US005987663A

United States Patent [19]

Ludlow et al.

[11] Patent Number: 5,987,663

[45] Date of Patent: Nov. 23, 1999

[54] MODULAR SYSTEM FOR SPAS AND BATHING SYSTEMS

[75] Inventors: David Jon Ludlow, Salt Lake County; Stephen M. Fleischer, Orem, both of Utah

[73] Assignee: Bullfrog International, L.C., Sandy, Utah

[21] Appl. No.: 09/176,122

[22] Filed: Oct. 21, 1998

Related U.S. Application Data

[63] Continuation-in-part of application No. 09/037,787, Mar. 10, 1998, which is a continuation of application No. 08/677,840, Jul. 10, 1996, Pat. No. 5,754,989.

[51] Int. Cl.[6] ..... A47K 3/00

[52] U.S. Cl. ..... 4/541.1

[58] Field of Search ..... 4/492, 541.1–541.6

[56] References Cited

U.S. PATENT DOCUMENTS 5,333,324 8/1994 Pinciaro ..... 4/567

5,682,625 11/1997 Leaverton et al. ..... 4/559 X

*Primary Examiner*—Charles E. Phillips

*Attorney, Agent, or Firm*—James L. Sonntag

[57] ABSTRACT

An upgradable spa or bathing system where jets are mounted on jet panel that covers a pod. The jet panel and pod enclose the air and water supply systems to the jets, which are configured with a manifold system to easily release the jets and the jet panel for repair or replacement of the jets. A separate upper panel covers the upper portion of the pod and includes an attachment to the spa shell and a headrest. The jet panel is held in place by engagement with structure on the shell and the upper panel and may be replaced without also replacing the head rest or the shell attachment of the top cover.

23 Claims, 4 Drawing Sheets

MODULAR SYSTEM FOR SPAS AND BATHING SYSTEMS

RELATED APPLICATIONS

This application is a continuation-in-part of Ser. No. 09/037,787, filed Mar. 10, 1998, which is a continuation of application Ser. No. 08/677,840, filed Jul. 10, 1996, which is now U.S. Pat. No. 5,754,989, issued May 26, 1998.

STATEMENT REGARDING FEDERALLY SPONSORED RESEARCH OR DEVELOPMENT (Not applicable)

FIELD OF THE INVENTION

This invention relates to spas and bathing systems.

BACKGROUND OF THE INVENTION

Bathing appliances in the nature of spas, or so-called hot tubs, have become commercially successful. These spas are typically constructed as a molded shell to form a water containment, with seats, footwells, platforms for reclining, and the like molded into the shape of the shell. The shell is usually molded from plastic or fiberglass or a composite thereof. A pump or pumps usually placed in a chamber under the shell draw water from the water containment and reinject the water, usually with air, into the containment through a variety of nozzles, hydrotherapy jets, and the like. The jets are usually mounted in the shell under the water line, and are designed to provide a comforting or therapeutic effect to a person in the spa. The jets are usually mounted by making a hole in the shell, and fixing the jet in the hole by a use of seals, adhesives, welding compounds, or a combination thereof. Water supply lines from the pumps to the jets are usually flexible tubing or rigid PVC tubing. After the jets and tubing are in place, an expandable foaming polymeric material is blown into the empty spaces to provide thermal and sound insulation. This construction system has been used widely and successfully, and is currently almost universally used.

One of the problems of conventional spa construction is that the configuration of the spa is essentially fixed at the time of construction. Since the jets are fixed in a hole in the spa shell, replacement of the jet is difficult or impractical. Replacement in the least would required an extensive reconstruction involving removing the old jet (usually by cutting out the jet), and installation of the new jet requiring repair and resealing of the shell around the new jet. In addition, the water and air supply lines to the jets must be replaced or reinstalled on the new jet, requiring access from the bottom of the spa and removal and replacement of the foam insulation surrounding the lines. Because such replacement is burdensome, a user will usually avoid a jet replacement unless absolutely necessary. If a new jet type is introduced into the market or the tastes of the bather change for a difference jet type, the difficulties of replacement basically preclude user from changing the jets.

There have been proposals to alleviate this problem, but none have met with commercial success. An example, disclosed in U.S. Pat. No. 5,172,433, to Lake, is a spa comprising a single large water-containing vessel. The spa has threaded holes in the wall of the vessel for attachment of furniture. Unused holes are blocked with a threaded plug. Jets, which are mounted in the removable furniture, are supplied with water and air by lines or hoses extending from holes in the wall of the vessel to the jet. While this system permits modification of the spa jets and furniture configuration, it does so at the cost of a multitude of holes through the wall of the water containment, which represents substantial risk of leaks, and significant costs in providing multiple mounting threaded holes. In addition, it would be difficult cumbersome to remove the separate air and water lines for the jets to remove the furniture. Where there are multiple jets, it would involve a multitude of hoses and connectors for each jet station.

Discussion of Previous Application

In U.S. Pat. No. 5,754,989, which is hereby incorporated by reference, is disclosed a spa wherein jets are mounted upon removable panels, that represent the back rests for various reclining positions in the spa. Basically the system disclosed comprises a spa shell with hollows or pods molded into the spa shell. The jets are mounted to direct water into the spa containment by attachment to the removable panel, which is also a cover over the pod. Jet supply lines are attached to the backside of the removable panel and communicate with a water supply by a removable attachment. This allows a user to easily remove the panel and the water supply lines of the jets in order to replace a panel. The removable panel covers the pod and includes structure for attaching the top of the panel to the spa shell and usually also a surface that functions as a head rest or an attachment for a separate head cushion.

The removable panel system has proven to be successful in providing an easy user-upgradable system. To replace a malfunctioning jet or upgrade to a new jet configuration, the user easily disconnects the top of the panel from the shell to gain access to the manifold system, disconnects jet supply lines at the manifold, and removes the panel. A new panel with the new jet is then inserted in place by first inserting the bottom of the panel under the retaining lip of the hollow, reattaching the jet supply lines and reattaching the top of the panel. A problem with this design occurs when there is a change in the structure for attaching the top of the panel, or a change in configuration of the headrest. If a new panel is to be attached at its top to the shell, it must have the identical fixture for attachment as the original panel. If the spa is to remain truly upgradable, the attachment system must remain the same for all new panels, or the spa has to be reconstructed with the new attachment system. For example, a spa with a screw attachment system, cannot be upgraded with panels that use locking pins. This severely compromises the ability of the manufacturer to improve and upgrade the attachment system of the panels, while keeping the new system compatible with older models.

Another problem involves the headrests. If the configuration of the headrest on the new panel is different from the old headrest, it will differ from those that remain from the original spa construction. Thus, the user is presented with a hodgepodge appearance of different styles on the spa, which is undesirable and unacceptable to many users. Since it is desirable from a marketing standpoint for a manufacturer to periodically change the style of headrests to respond to changing tastes and technologies, it is not desirable that the design of the headrest be unchangeable. In addition, it is also not practical for a spa supplier to maintain an inventory of all discontinued headrests and attachment systems.

It would therefore be desirable to provide the easy upgradability as in the system of U.S. Pat. No. 5,754,989, but providing a greater flexibility. This would permit a new attachment and headrest systems for new spas, while retaining compatibility for new panel-mounted jets with old spa models.

Objects of the Invention

It is, therefore, an object of the invention to provide an improvement over the modular jet system of U.S. Pat. No. 5,754,989 where the problems of upgradability of the system are solved.

Further objects of the invention will become evident in the description below.

BRIEF SUMMARY OF THE INVENTION

The present invention is an improved jet mounting system comprising pods molded into the spa shell. A jet panel functions as a cover over the pod with jets mounted in the panel. Water and air supply lines and related structure are also supported upon the backside of the pod. The water supply lines are connected to the water supply system by a releasable manifold connection. This allows the jet panel and attached jets and supply lines to be easily removed and replaced by a user. A top panel supports the top edge of the jet panel and serves as a top cover to the pod, so that the jet panel and the top panel enclose the pod volume. The top panel includes structure for attaching the top panel to the spa shell to support the top panel and, in turn the top of the jet panel. The top panel may also be shaped to form a headrest surface, or include structure for attaching a headrest.

By separating the functions of the jet panel from those of the top panel, the flexibility and possibility for upgrading are materially increased. A jet panel can be changed without any consideration that attachment to the spa shell is compatible of the original jet panel installation. In addition, the jet panels can be replaced without changing the original head rests, which allows upgrading of the spa while retaining the original head rest style.

Index of Reference Numbers

Figure 1:
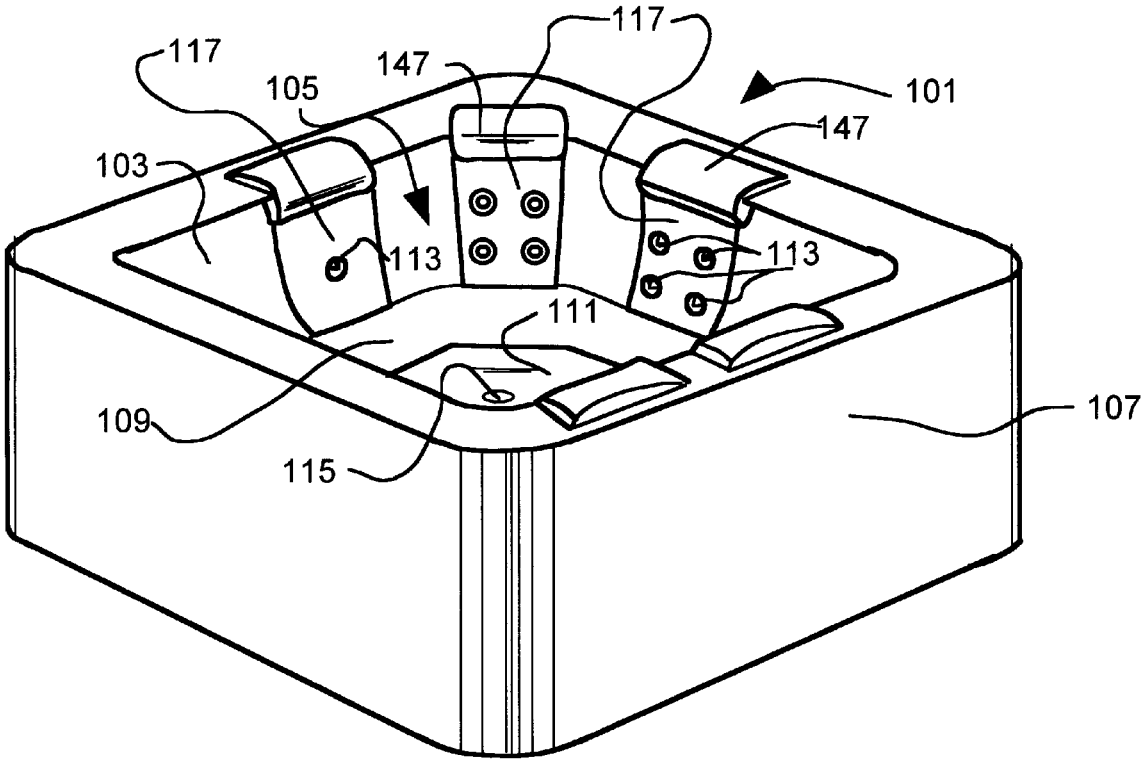
FIG. 1 is a perspective view of a spa of the invention.

101 spa
103 shell
105 containment
107 skirt cabinet
109 platform
111 foot well
113 jets
115 drain
117 jet panel
119 pod
121 water supply line
123 manifold
125 manifold ports
127 jet water supply lines
129 manifold pipe section
131 manifold sleeve
133 jet air inlet
135 jet water inlet
137 jet air supply lines
139 air supply system
141 union connectors
143 mounting ridge in shell
145 lower edge of jet panel
147 top panel
149 front ridge of top panel
151 top edge of jet panel
153 side holding pins
155 rear holding pins
157 top panel fingers
159 jet outlet
163 contoured surface of top panel
165 holes for cushion mount
167 cushion
169 pegs
171 jet pack

DETAILED DESCRIPTION OF THE INVENTION

Referring to FIG. 1, which is a perspective view of a spa of the invention, the spa 101 comprises a shell 103 to provide a containment 105 for water, and a skirt cabinet 107 that conceals the support structure, the pumping, filtration and circulation equipment, etc. The shell 103 and the skirt 107 are constructed in a conventional manner. Typically, the shell is fiberglass, or other suitable material, with foam insulation under the shell. The shell 103 is shaped to incorporate a seating or lounging platform 109 and a foot well 111.

The spa 101 includes jets 113 through which water, usually mixed with air, is directed under pressure into the containment 105. A drain 115 or drains are provided to withdraw water from the containment, which is then recirculated back into the containment through the jets 113.

Figure 2:
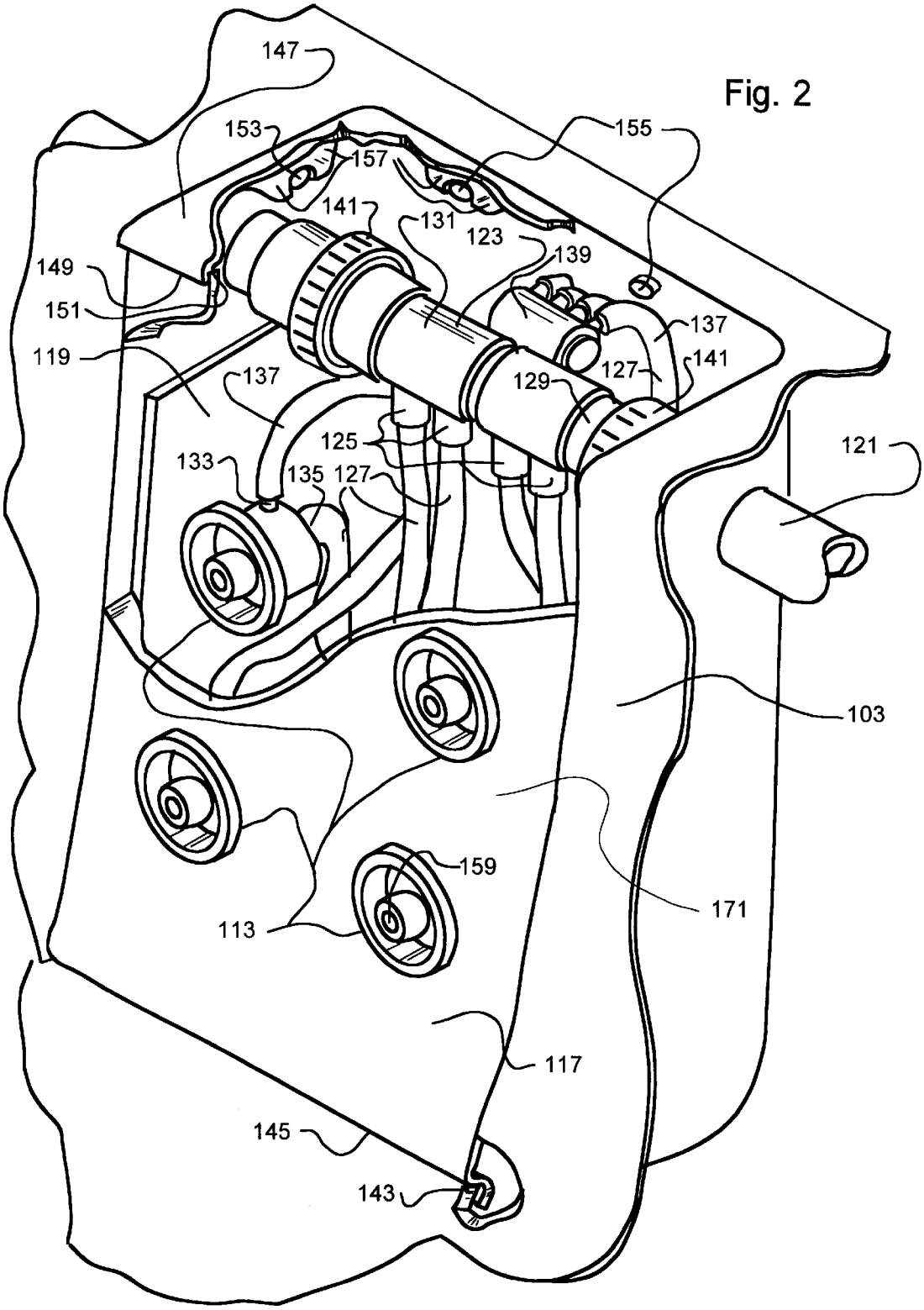
FIG. 2 is a detail view of one of the pods, with attached jet panel and top panel of a spa as in FIG. 2.

Referring also to FIG. 2, the jets are mounted on a jet panel 117 that provides a cover over a well or pod 119 molded into the shell. Preferably, the outer surface of the jet panel 117 is generally flush with the adjacent surface of the shell 103.

A water supply line 121 enters the pod 119 from a side of the pod and extends through the pod to the other side. The water supply line is preferably mounted around the periphery of the containment above the water line as disclosed in U.S. Pat. No. 5,754,989. A manifold 123 provides one or more manifold ports 125 as needed for jet water lines 127 that feed water to one or more jets 113 mounted on the jet panel 117. The manifold 123 is constructed to form a releasable attachment of the jet water supply lines 127 to the water supply line 121. This enables a user to disconnect the jet water lines 127 and jets 113 from the water supply line 121. In the figure, the manifold 123 is formed with a pipe section 129 from the same pipe material as the water supply line 121 with a sleeve 131 covering the pipe section 129. The sleeve 131 is formed with one or more ports 125 for connection to the flexible jet water lines 127 that supply pressurized water to the jets 113. The jets 113 may be of any suitable construction, usually comprising an air inlet 133 and water inlet 135. The jet 113 mixes air and water and directs the mixture as one or more pressurized streams into the containment. In the figure, the water and air inlets 135, 133 are shown on the side and the back of the jet, respectively, but the jet may also be configured differently, for example with both ports on the side, or back. The air inlet 133 of each jet 113 is connected via air supply lines 137 to an air intake system 139, which in the figure is an air intake manifold and an air filtering system. On either end of the water supply manifold are union connectors 141 which allow easy disconnection and removal of the assembly comprising the manifold 123, jet water and air lines 127, 137, air supply manifold 139, and associated jets 113. This allows easy replacement, maintenance, upgrading or repair of any components of the assembly.

The jets are supported in the pod on the pod cover plate, i.e., the jet panel 117, which covers the cavity or depression forming the pod 119. The jet panel 117 is held in place at its bottom edge by engagement with the spa shell. In FIG. 2 a ridge 143 on the shell 103 at the bottom periphery of the pod 119 engages the lower peripheral edge 145 of the jet panel 117. The attachment of the jet panel 117 to the shell edges is preferably non-sealing with respect to water to permit free passage of water between the interior of the pod 119 and the major containment 105 of the shell. Alternately, the jet panel 117 may have apertures (not shown) for the flow of water.

The top of the jet panel 117 is supported by a top panel 147, which also functions as a top cover of the pod 119. The top panel 147 has appropriate structure, such as a front ridge 149, to engage the top edge 151 of the jet panel 117. The top panel 147 is held in place to the shell 103 over the pod 119 by any appropriate structure. In FIG. 2 are shown side and rear holding pins 153, 155 mounted on the shell. The top panel includes fingers 157 in a generally inverted U-shape configuration to engage the side and rear holding pins 153, 155. By providing pins 153, 155 on both of the back and the side of the pod 119, the top cover is restrained from movement both front to back and side to side. Alternate construction is contemplated for supporting the top panel, such as, for example, shelf structure in the shell that supports the lateral edges of the panel. Appropriate screws, clamps, clips or other fasteners (not shown) may also be used alone or in combination with other means to secure the cover in place.

The jet panel 117 is preferably configured to provide a pleasing visual appearance and to provide a comfortable resting surface for the back of a bather. The top panel 147 may be shaped as a plain cover as shown or, preferably, constructed to incorporate a head rest surface, cushion, or other suitable headrest. Since the manifold 123, and associated supply lines 137, 127, etc., are hidden in the pod by the jet and top panels 117, 147, the only visible part of the circulation system is the outlet of the jet 113. There are no projecting pipes or the like that would be unsightly or present a hazard. Visually speaking, essentially the only difference between the water containment of a spa of the invention and a prior art spa is the inconspicuous joint around the top and jet panels where they fit into the shell. The jet panel 117 and top panel 147 may also be optionally configured to provide ridges or contours to provide decoration or custom contours. In the jet panel 117, contours may be molded for lumbar back support.

Figure 3:
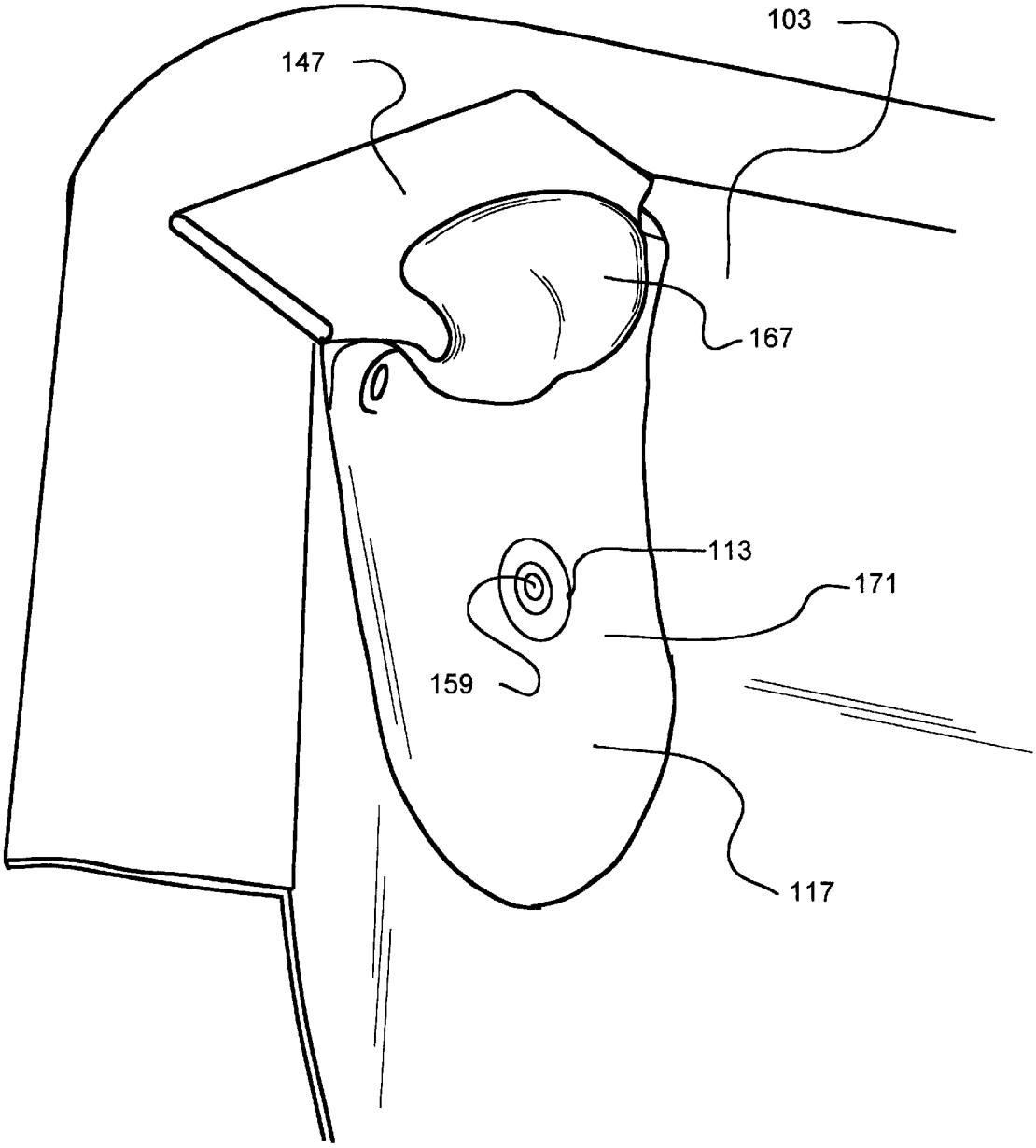
FIG. 3 is a detail view of an alternate pod, jet panel, and top panel of a spa of the invention.
Figure 4:
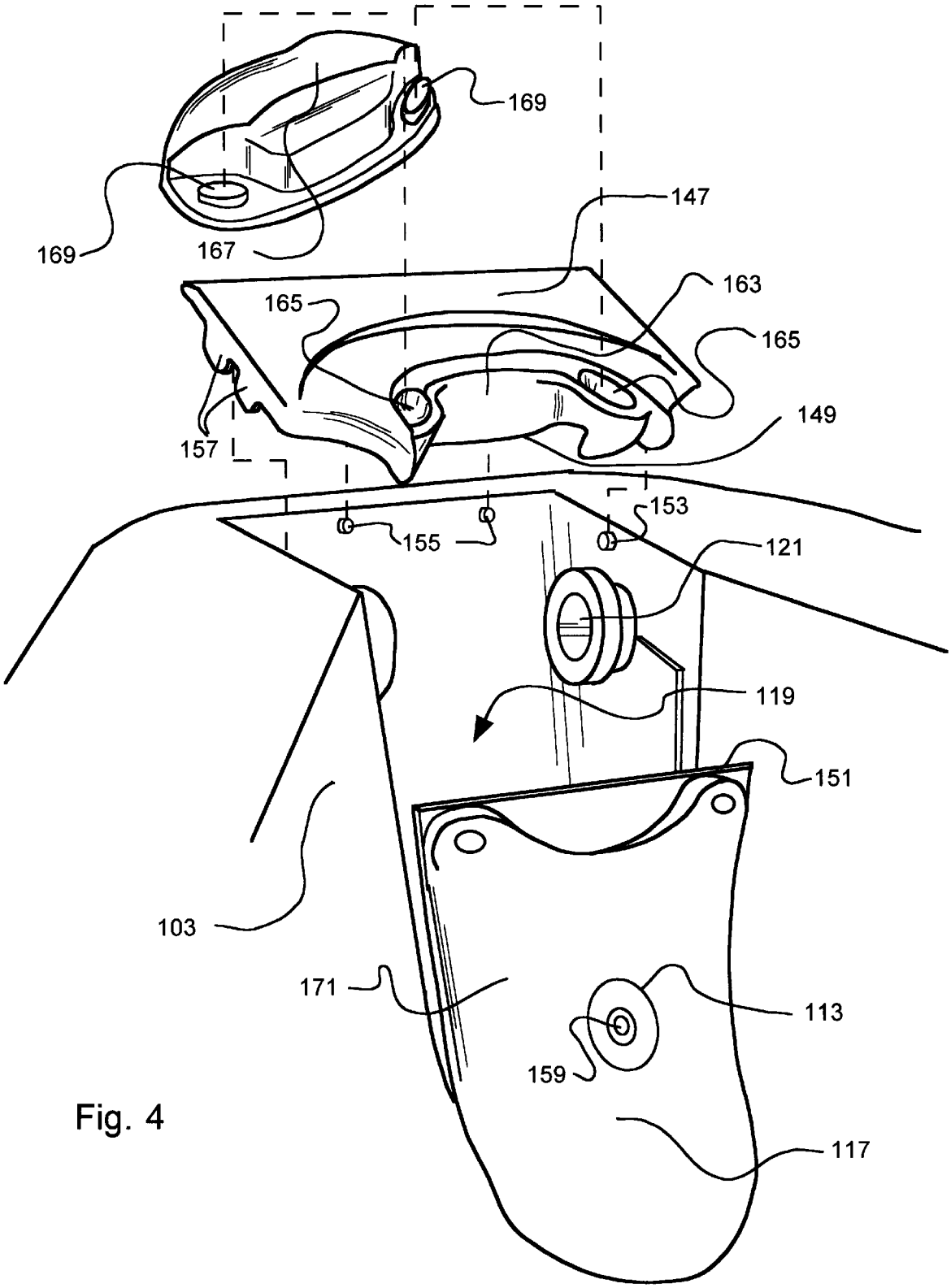
FIG. 4, is an exploded view of the pod, jet panel and top panel of FIG. 3.

Reference is now made to FIGS. 3 and 4, which show an alternate embodiment of the invention, with the same reference numbers referring to analogous parts in FIGS. 1 and 2. In this embodiment, the bottom edge of the jet panel engages a ridge in the shell as in FIG. 2. The jet panel 117 comprises one or more jets 113. The water supply manifold, air manifold, and air and water supply lines (not shown) are mounted in a manner similar to FIG. 2 to the backside of the jet panel behind the jet. The top panel has inverted U-shaped fingers 157 that engage side and rear mounting pins 153, 155 in the shell, and a front ridge 149 that engages the top of the jet panel. The top panel also has a contoured surface 163 and includes mounting holes 165 for mounting a cushion member 167. The cushion 167 has structure that engages the cushion mounting structure of the top panel in the form of pegs 169 to engage the mounting holes 165. When assembled, as shown in FIG. 3, the jet panel 117, the top panel 147, and cushion 167, provide a visually pleasing and comfortable back and head rest for a user.

The jet-pack 171, which herein is defined as the assembly of the jet panel 117, with attached jets 113, jet air and water supply lines 137, 127, and air and water supply manifolds 139, 123, is easily removed from the spa. Referring to both embodiments, particularly to FIGS. 2 and 4, the top panel 147 is lifted by simply lifting it up by its front. This raises the top panel 147 from the side pins 153. The top panel 147 is then pulled to remove the panel from the rear pins 155. In the embodiment of FIG. 4, the cushion 167 is first removed from the top panel 147. After the top panel 147 is removed, the top of the jet panel 117 is freed allowing the jet panel to be tipped out around its bottom edge to gain access to the interior of the pod 119. The union connectors 141 associated with the manifold are then released and the jet-pack 171 is then removed. Alternately, the jet supply lines 127 can be removed from their respective connection to the manifold 123 instead of disconnecting the union connectors 141. The jet-pack 171 can then be easily repaired, modified or upgraded, and then returned to the spa by reversal of the steps. The jet-pack 171 can also be replaced by a new jet-pack of the same or a different configuration. The originally installed top panel 147 and the cushion 167 can be used with the newly installed jet-pack 171. In this manner, the jet-pack 171 can be upgraded without regard to conflicts in the mounting system of the top panel 147 or the style of the cushion 167. By practice of the present invention, a spa can be customized and modified at will by replacing any of the jets, with only a minimum of training and in only a short amount of time. The upgraded spa retains the essential visual appearance of the original installation and no reconstruction of the mounting system is required since it is simple to construct all jet packs to engage the shell lip and top panel ridge.

In addition, the jets can be replaced without first emptying the spa. In contrast, the replacement of jets in prior-art spas is difficult and the replacement with a different type of jet in many cases is difficult or impossible. Replacement of the jet in a prior-art spa, whether for repair or to change the type, may involve the same laborious procedure involved in repairing leaks, i.e., tipping up the spa and removing the foam. In addition, a new jet must accommodate and be sealed into the existing penetration of the shell or the shell penetration must be modified. If the new jet requires a smaller penetration hole than the existing hole, it may not be practical or possible to seal the new jet into the shell penetration.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. An upgradable spa or bathing system comprising:

a molded spa shell configured with pods in the form of hollows molded into the shell;

a water supply system for supplying pressurized water into the pod;

a jet panel configured to cover a lower portion of the pod;

at least one jet mounted on the jet panel, with pressurized water from the water supply system provided to the jet by at least one jet water line attached to the water supply system by a releasable connection;

a top panel configured to cover an upper portion of the pod, the top panel comprising structure for releasable attachment to the shell and structure to provide a head-rest surface for a bather, the jet panel being retained in place by engagement of a top edge of the jet panel with structure on the top panel, and by engagement of a bottom edge of the jet panel on structure on the shell, such that the jet panel, the jets and jet water supply line can be removed as a unit after release of the releasable connection.

2. An upgradable spa or bathing system as in claim 1 wherein the structure in the top panel to provide a head-rest is an external surface molded into the top panel.

3. An upgradable spa or bathing system as in claim 1 additionally comprising a cushion and wherein the structure in the top panel to provide a head-rest is structured to attach the cushion to the top panel.

4. An upgradable spa or bathing system as in claim 1 wherein the top edge of the jet panel engages a retaining ridge on an underside of the top panel.

5. An upgradable spa or bathing system as in claim 1 wherein the structure on the shell that engages the bottom edge of the jet panel is a retaining ridge in the shell disposed at the peripheral edge of the pod.

6. An upgradable spa or bathing system as in claim 1 wherein the structure of the top panel for releasable attachment to the shell comprises fingers that engage at least one pin in the wall of the shell.

7. An upgradable spa or bathing system as in claim 1 wherein the releasable connection comprises a manifold connector with at least one water inlet and at least one water outlet, with a water supply line from the water supply system disposed in the pod for at least a portion of its length and extending to the water inlet of the manifold connector, a jet supply line connected to the water outlet of the manifold connector and extending to the at least one jet.

8. An upgradable spa or bathing system as in claim 7 wherein the at least one jet additionally comprises at least one air supply line extending from the jet to an air intake manifold disposed in the pod.

9. An upgradable spa or bathing system as in claim 8 wherein the air intake manifold is attached to the manifold connector such that the air supply lines and intake manifold are removed while attached to the manifold connector when the manifold connector and connected jet supply lines and jets from the water supply line are removed from the water supply line.

10. An upgradable spa or bathing system as in claim 7 wherein the manifold connector additionally comprises a water line outlet for a series water connection with a second manifold connector of similar construction.

11. An upgradable spa as in claim 7, wherein the manifold connector comprises a releasable union connector to separate the jet supply line from the water supply line.

12. An upgradable spa or bathing system comprising:

a molded spa shell configured with pods in the form of hollows molded into the shell;

a water supply system for supplying pressurized water into the pod;

a jet panel configured to cover a lower portion of the pod;

at least one jet mounted on the jet panel, with pressurized water from the water supply system provided to the jet by at least one jet water line attached to the water supply system by a releasable connection;

a top panel configured to cover an upper portion of the pod, the top panel comprising structure for releasable attachment to the shell and structure for engagement of a top edge of the jet panel to retain the jet panel.

13. An upgradable spa or bathing system as in claim 12 wherein the bottom edge of the jet panel engages a retaining ridge in the shell disposed at the peripheral edge of the pod.

14. An upgradable spa or bathing system as in claim 12 wherein the structure of the top panel for releasable attachment to the shell comprises fingers that engage at least one pin in the wall of the shell.

15. An upgradable spa as in claim 13 wherein the top panel is configured with structure to provide a head-rest surface for a bather.

16. An upgradable spa or bathing system as in claim 15 wherein the structure in the top panel to provide a head-rest is an external surface molded into the top panel.

17. An upgradable spa or bathing system as in claim 15 additionally comprising a cushion and wherein the structure in the top panel to provide a head-rest is structured to attach the cushion to the top panel.

18. An upgradable spa or bathing system as in claim 12 wherein the structure for engagement of the top edge of the jet panel comprises a retaining ridge on an underside of the top panel.

19. An upgradable spa or bathing system as in claim 12 wherein the releasable connection comprises a manifold connector with at least one water inlet and at least one water outlet, with a water supply line from the water supply system disposed in the pod for at least a portion of its length and extending to the water inlet of the manifold connector, a jet supply line connected to the water outlet of the manifold connector and extending to the at least one jet.

20. An upgradable spa as in claim 19 the manifold connector comprises a releasable union connector to separate the jet supply line from the water supply line.

21. An upgradable spa or bathing system as in claim 20 wherein the air intake manifold is attached to the manifold connector such that the air supply lines and intake manifold are removed while attached to the manifold connector when the manifold connector and connected jet supply lines and jets from the water supply line are removed from the water supply line.

22. An upgradable spa or bathing system as in claim 20 wherein the manifold connector additionally comprises a water line outlet for a series water connection with a second manifold connector of similar construction.

23. An upgradable spa or bathing system as in claim 19 wherein the at lease one jet additionally comprises at least one air supply line extending from the jet to an air intake manifold disposed in the pod.

* * * * *